US009231342B2

(12) United States Patent
Kataoka et al.

(10) Patent No.: US 9,231,342 B2
(45) Date of Patent: Jan. 5, 2016

(54) CONNECTOR

(71) Applicant: Sumitomo Wiring Systems, Ltd., Yokkaichi (JP)

(72) Inventors: Shigeto Kataoka, Yokkaichi (JP); Mitsunori Kitajima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/337,734

(22) Filed: Jul. 22, 2014

(65) Prior Publication Data

US 2015/0037998 A1 Feb. 5, 2015

(30) Foreign Application Priority Data

Aug. 5, 2013 (JP) ..... 2013-162524

(51) Int. Cl.

*H01R 13/642* (2006.01)
*H01R 13/627* (2006.01)
*H01R 13/66* (2006.01)
*H01R 13/639* (2006.01)

(52) U.S. Cl.

CPC ..... *H01R 13/6272* (2013.01); *H01R 13/639* (2013.01); *H01R 13/6683* (2013.01)

(58) Field of Classification Search

USPC ..... 439/357, 489, 354, 352, 345
See application file for complete search history.

(56) References Cited

U.S. PATENT DOCUMENTS 5,217,390 A * 6/1993 Nozaki ..... H01R 13/641 439/353
5,759,058 A * 6/1998 Childs ..... H01R 13/641 439/352
6,234,826 B1 * 5/2001 Wilber ..... H01R 13/4368 439/352
6,261,116 B1 * 7/2001 Ceru ..... H01R 13/6272 439/352
6,435,895 B1 * 8/2002 Fink ..... H01R 13/6272 439/352
6,435,896 B1 * 8/2002 Takatsuki ..... H01R 13/6272 439/354
6,716,052 B2 * 4/2004 Kane ..... H01R 13/641 439/352
6,780,045 B2 * 8/2004 Shuey ..... H01R 13/641 439/352
7,108,542 B2 * 9/2006 Ishiwa ..... H01R 13/641 439/352
7,326,074 B1 * 2/2008 Lim ..... H01R 13/629 439/352
7,399,195 B2 * 7/2008 Kim ..... H01R 13/641 439/352
7,544,081 B2 * 6/2009 Lim ..... H01R 13/4361 439/352
7,909,638 B2 * 3/2011 Seo ..... H01R 13/6272 439/352
8,920,187 B2 * 12/2014 Kon ..... H01R 13/641 439/352
9,054,458 B1 * 6/2015 Ng ..... H01R 13/641
2007/0059969 A1 * 3/2007 Shamoto ..... H01R 13/641 439/352
2013/0237081 A1 * 9/2013 Kon ..... H01R 13/6272 439/350
2014/0134867 A1 * 5/2014 Kon ..... H01R 13/627 439/345

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A lock arm (33) is arranged on the upper surface of a female connector housing (27), and lock-arm protection walls (37) stand at opposite widthwise sides of the lock arm (33). Detector protection walls (38) are provided behind the lock-arm protection walls (37), and first and second lock receiving portions (43, 44) are formed on the inner surfaces thereof. Two inwardly deflectable locking arms (56) are formed on a detector (39) and locked to the first or second lock receiving portions (43, 44) to restrict a backward movement when the detector (39) is at an initial position and a detecting position. The locking arms (56) are arranged utilizing dead spaces behind the lock-arm protection walls (37).

4 Claims, 18 Drawing Sheets

CONNECTOR

BACKGROUND OF THE INVENTION

1. Field of the Invention

The invention relates to a connector.

2. Description of the Related Art

Japanese Unexamined Patent Publication No. 2005-251540 discloses a connection detector mounted in one connector to detect whether male and female connectors have been connected properly. The connection detector is held at an initial position without being able to move forward until a proper connected state is reached. However, forward movement of the detector is allowed when the male and female connectors reach the properly connected state and the connection detector is displaced to a detecting position.

In this connector, a pair of operating springs are formed on opposite widthwise sides of a detector and are locked to holding projections formed in a connector housing to restrict a backward movement of the detector when the detector reaches a connection position.

However, in the above connector, the operating springs deflect out in a width direction when being locked to the holding projections. Accordingly, deflection spaces have to be ensured at outer sides of the operating springs in the width direction. Thus, the positions of protection walls formed to cover the detector in the width direction are made more distant toward outer sides in the width direction by that much. As a result, there has been a problem of enlarging the connector in the width direction.

The present invention was completed based on the above situation and aims to realize the miniaturization of a connector provided with a detector for detecting connection in a width direction.

SUMMARY OF THE INVENTION

The invention is directed to a connector, including a connector housing connectable to a mating connector housing. A lock arm extends back from a front end part of the connector housing, and is formed to deflect in a height direction intersecting a connecting direction of the connector housing and the mating connector housing. The lock arm is configured to be locked to the mating connector housing to hold a connected state when the connector housing and the mating connector housing are connected properly. Two lock-arm protection walls stand on the connector housing and extending along the connecting direction at opposite sides of the lock arm in a width direction. A detector can be mounted into the connector housing for movement between an initial position and a detecting position. The detector is configured to contact the lock arm from behind to restrict a forward movement at the initial position before the connector housing is connected to the mating connector housing. The detector can enter a deflection space for the lock arm to restrict the deflection of the lock arm when being released from a movement restricted state at the initial position and reaching the detecting position by being pushed forward from the initial position when the connector housing is connected properly to the mating connector housing. Detector protection walls are configured to cover the detector by standing behind and at widthwise outer sides of the lock-arm protection walls on the connector housing. Locking arms are formed on opposite widthwise sides of the detector and are resiliently deformable inwardly in the width direction. First and second lock receiving portions are formed on the inner surfaces of the detector protection walls and can be locked releasably to the locking arms when the detector is at the initial position and the detecting position for restricting a backward movement of the detector. The locking arms are arranged to cross backward extensions of the lock-arm protection walls in the connecting direction toward widthwise inner sides when being resiliently deformed.

According to the invention, locking arms utilize dead space behind the lock-arm protection walls. Thus, the connector is miniaturized in the width direction.

The first and second lock receiving portions may be displaced so not to overlap in a height direction in a rear view of the connector. Accordingly, the first and second lock receiving portions can be molded by removing a mold backward. Thus, a mold structure can be simplified.

Claws may project out in the width direction on the tips of the locking arms. Rear surfaces of the claws in the connecting direction may be able to contact the front surfaces of the first lock receiving portions when the detector is at the initial position. Accordingly, the claws of the locking arms are lockable to the front surfaces of the first lock receiving portions when the detector is at the initial position. Thus, a detachment of the detector from the connector housing is restricted.

The front and rear surfaces of the claws may be able to contact the rear surfaces of the lock-arm protection walls and the front surfaces of the second lock receiving portions so as to be able to hold the detector at the detecting position when the detector is at the detecting position. Thus, the claws of the locking arms can contact the rear end surfaces of the lock-arm protection walls when the detector is at the detecting position. Thus, the detector is prevented from being pushed any farther forward. Further, the claws can simultaneously contact the front surfaces of the second lock receiving portions so that the detector cannot return to the initial position can be avoided.

DETAILED DESCRIPTION OF THE PREFERRED EMBODIMENT

Figure 1:
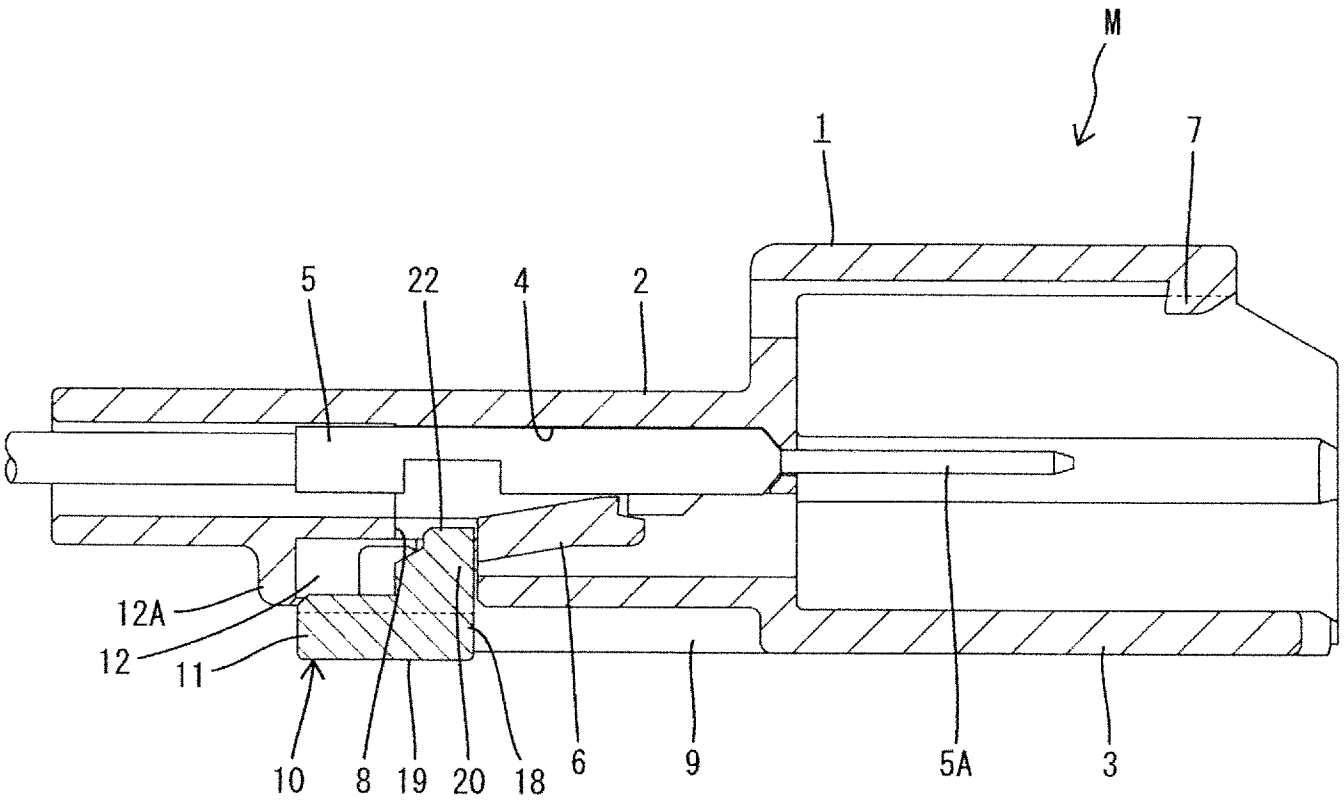
FIG. 1 is a side view in section when a retainer is at a partial locking position in a male connector.

A specific embodiment of a connector assembly of the invention is described with reference to the drawings. Note that, in the following description, front and rear ends in a connecting direction of male and female connectors are referred to as a "front end" and a "rear end" and a direction extending from a front side to a back side of the plane of FIG. 1 is referred to as a "width direction".

Figure 2:
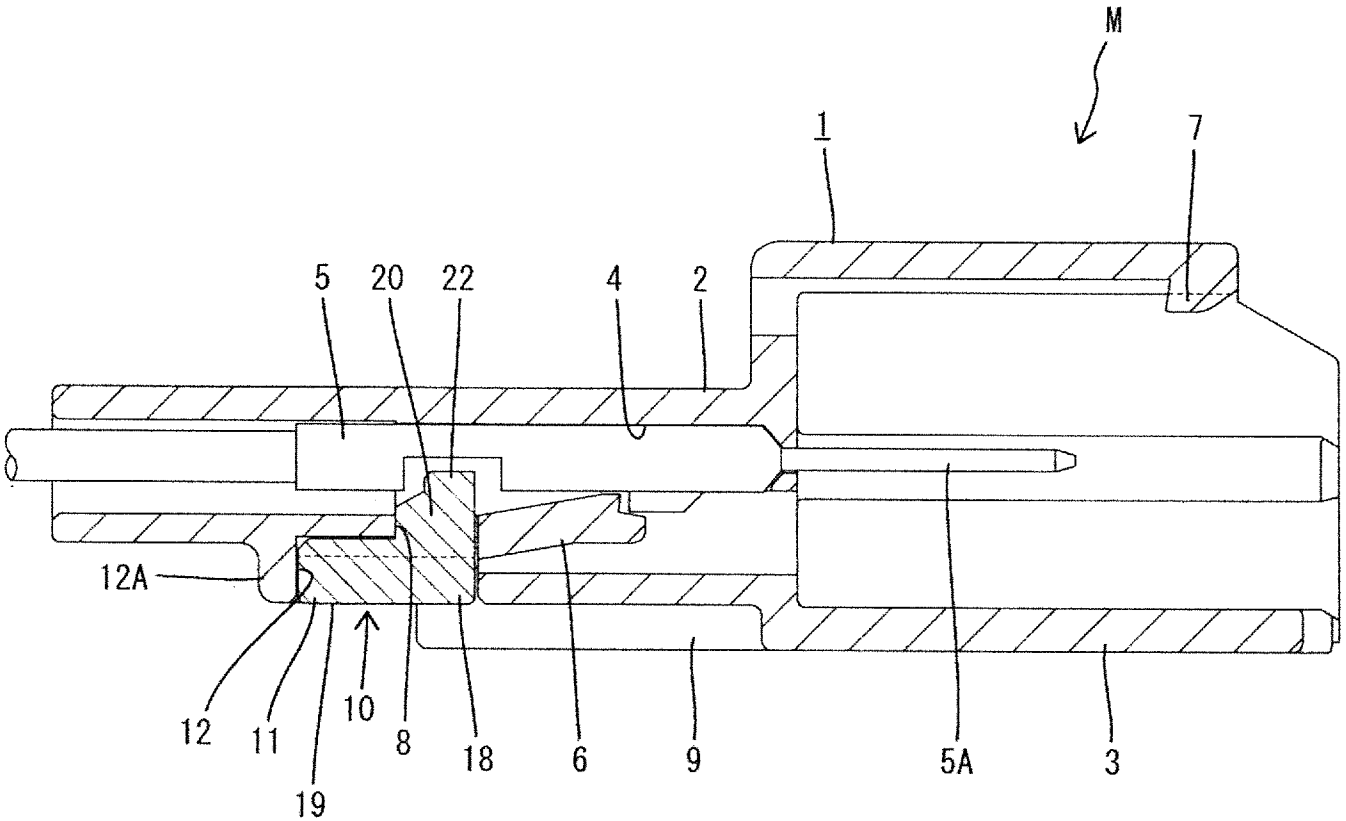
FIG. 2 is a side view in section when the retainer is at a full locking position.
Figure 9:
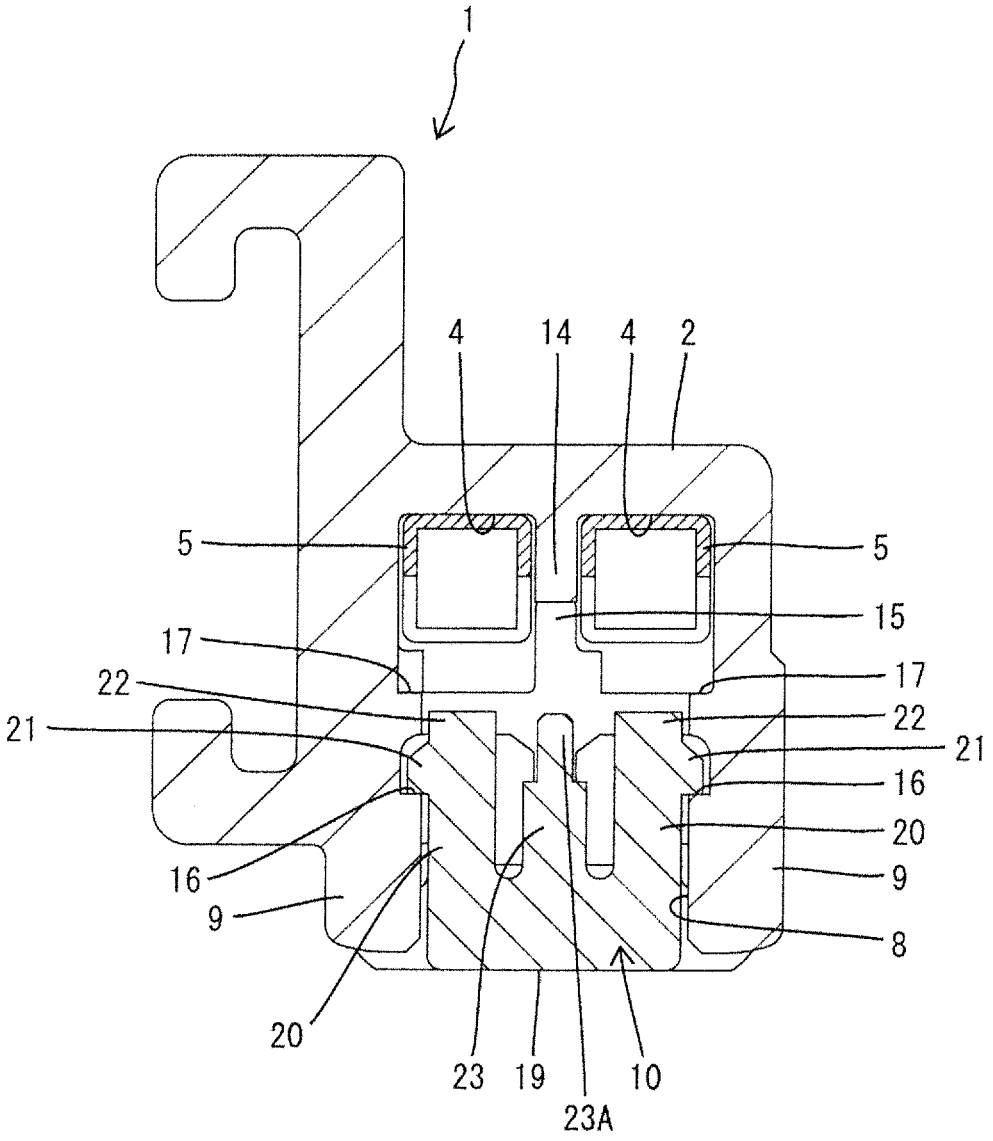
FIG. 9 is a section along A-A of FIG. 4 when the retainer is at the partial locking position.
Figure 10:
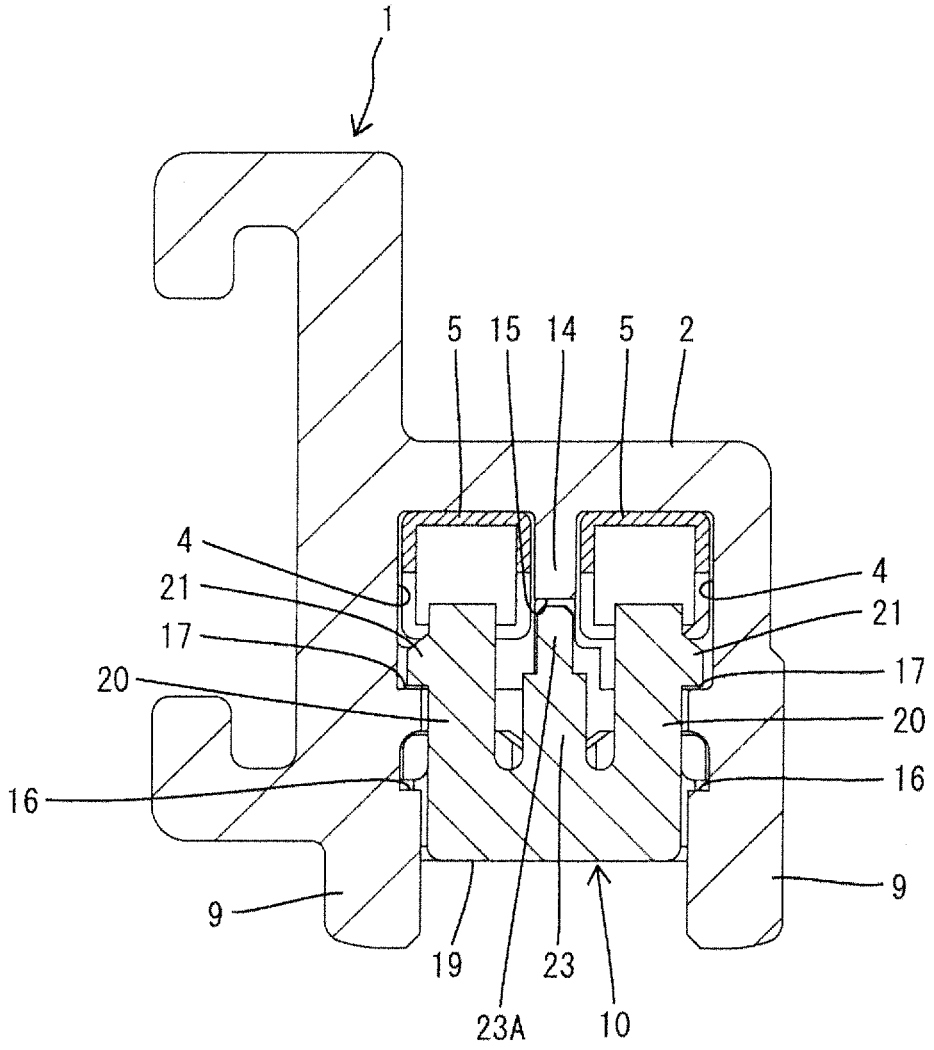
FIG. 10 is a section along A-A of FIG. 4 when the retainer is at the full locking position.

The connector assembly has a male connector M with a male connector housing 1 made of synthetic resin. A rear end of the male connector housing 1 in a connecting direction to a female connector F defines as a terminal accommodating portion 2, and a rectangular tubular receptacle 3 is formed on a front end. As shown in FIGS. 9 and 10, two cavities 4 are arranged side by side in the width direction in the terminal accommodating portion 2. Each cavity 4 is capable of accommodating a male terminal fitting 5, and a locking lance 6 is provided substantially in a central part in the cavity 4 for primarily locking the male terminal fitting 5. As shown in FIGS. 1 and 2, the locking lance 6 is cantilevered obliquely forward and is resiliently deformable in a vertical direction in FIGS. 1 and 2.

Tabs 5A of the male terminal fittings 5 project into the receptacle 3 and are arranged side by side in the width direction. A lock protrusion 7 projects down at a widthwise central part of the upper side of the opening edge of the receptacle 3.

Figure 3:
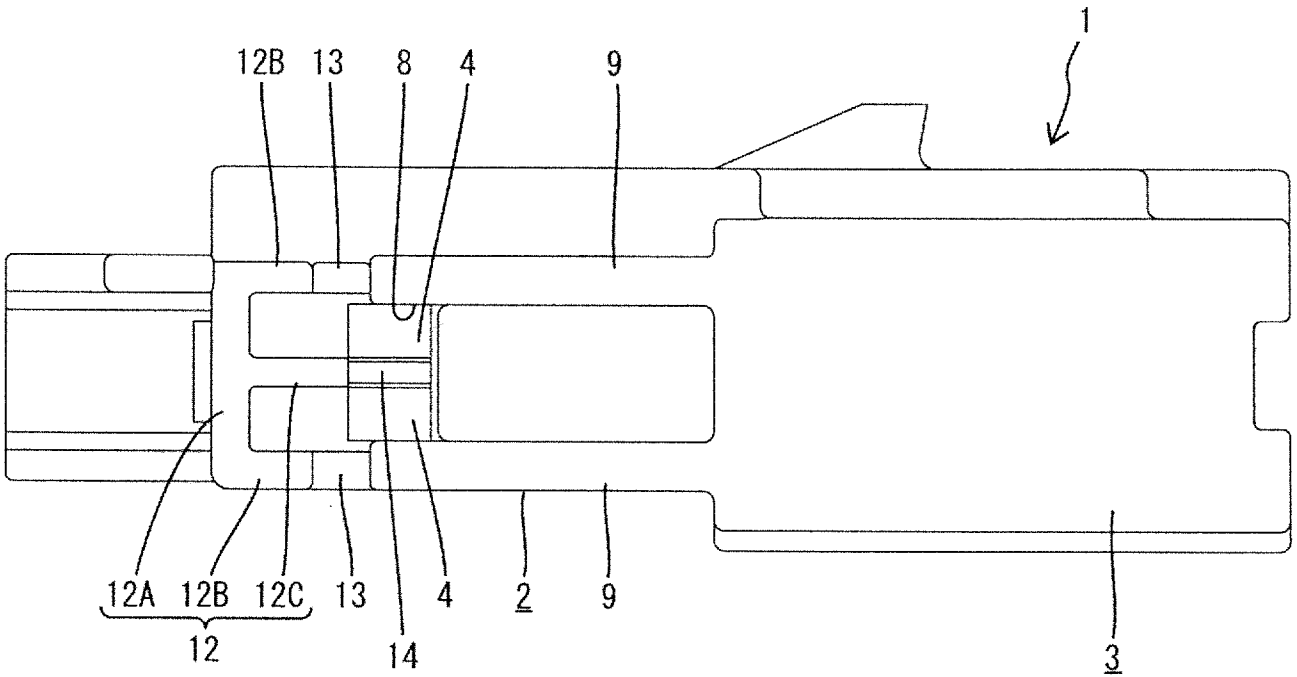
FIG. 3 is a bottom view of a male connector housing.

A retainer insertion hole 8 is open on the lower surface of the terminal accommodating portion 2 at a position behind the locking lances 6 and communicates with both cavities 4. As shown in FIGS. 1 and 3, a widthwise central part of the lower surface of the terminal accommodating portion 2 in an area before the retainer insertion hole 8 and extending up to the receptacle 3 is slightly higher while leaving opposite side parts in the width direction. Thus, two elongated projections 9 are formed on and along the opposite widthwise sides of the lower surface of the terminal accommodating portion 2 (see FIG. 3). The front ends of the elongated projections 9 are continuous and flush with the lower surface of the receptacle 3, and the rear ends thereof are at positions slightly before the rear opening edge of the retainer insertion hole 8 (see FIGS. 1 and 3). An accommodating frame 12 projects on a side of the lower surface of the terminal accommodating portion 2 behind the retainer insertion hole 8 for accommodating extended portions 11 of a retainer 10 to be described later.

This accommodating frame 12 has a rear wall 12A extending over the entire width of the terminal accommodating portion 2. Two side walls 12B extend forward from the opposite widthwise sides of the rear wall 12A and are on the same straight lines as the elongated projections 9. A center wall 12C extends forward from a widthwise central part of the rear wall 12A, and the heights of these walls are substantially flush with a part between the two elongated projections 9. Further, the front ends of the opposite side walls 12B are slightly behind the front end of the center wall 12C and two positioning recesses 13 are defined between the front ends of the side walls 12B and the rear ends of the elongated projections 9.

Figure 8:
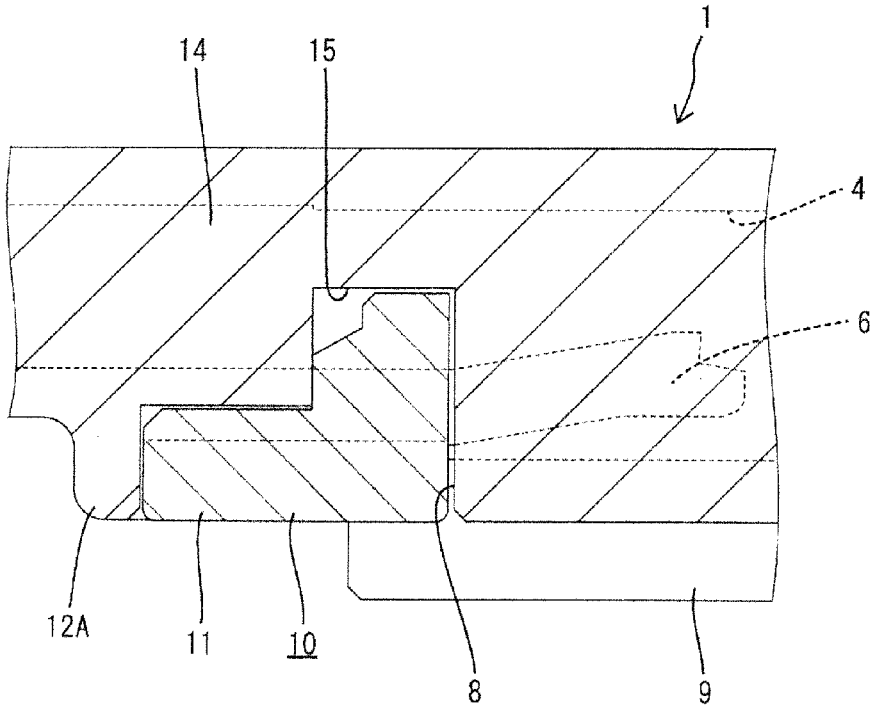
FIG. 8 is an enlarged section showing a state where a posture correcting portion of the retainer is fitted in a recess of a partition wall to hold the retainer in a proper posture.

A cut recess 15 having a width substantially equal to the width of the retainer insertion hole 8 in a front-back direction is formed by cutting at a position of a partition wall 14 partitioning between the cavities 4 in an arrangement direction where the retainer insertion hole 8 is open (see FIGS. 3 and 8).

As shown in FIGS. 9 and 10, partial lock receiving portions 16 and full lock receiving portions 17 are provided on widthwise outer wall surfaces of a wall of the retainer insertion hole 8 while being paired in the width direction. The partial lock receiving portions 16 are at shallow positions in the retainer insertion hole 8 and the full lock receiving portions 17 are at positions deeper than the partial lock receiving portions 16. The partial lock receiving portions 16 hold the retainer 10 at a partial locking position (position shown in FIGS. 1 and 9) and the full lock receiving portions 17 hold the retainer 10 at a full locking position (position shown in FIGS. 2 and 10).

Figure 4:
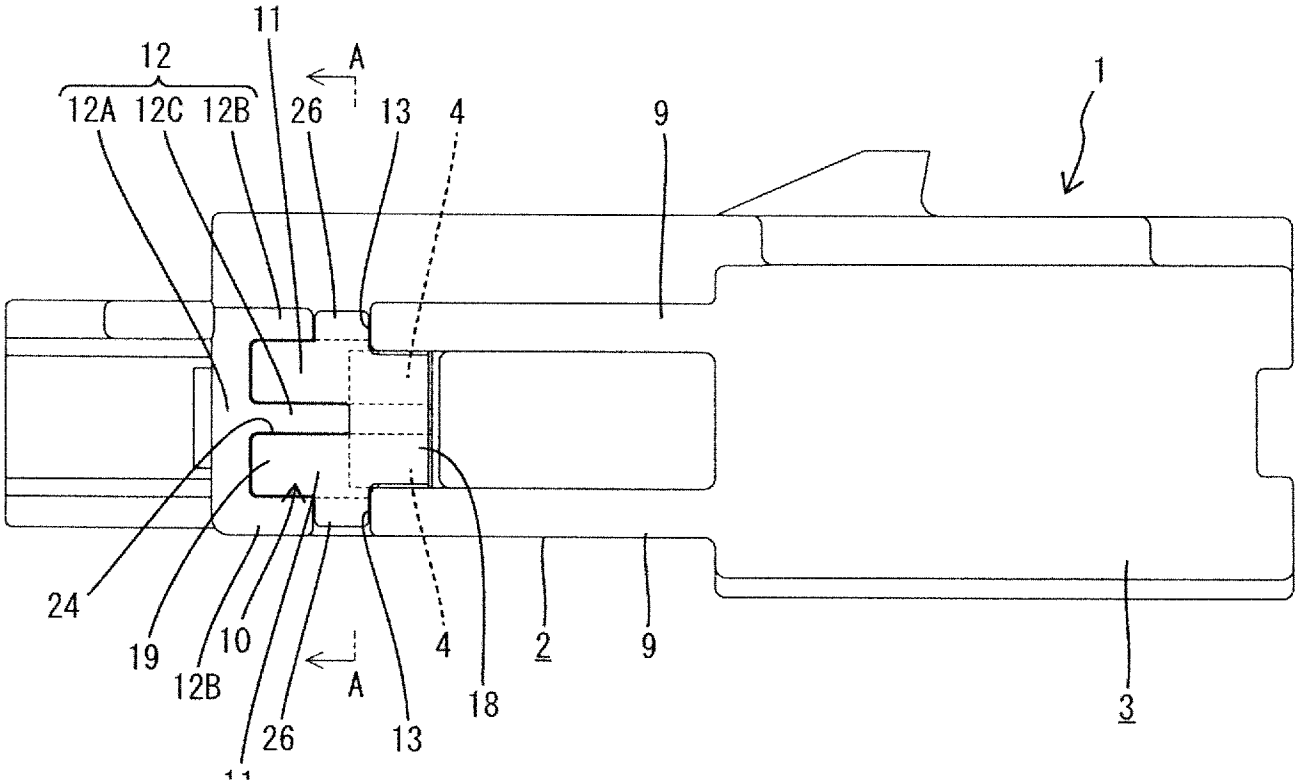
FIG. 4 is a bottom view of the male connector when the retainer is at the partial locking position or at the full locking position.
Figure 5:
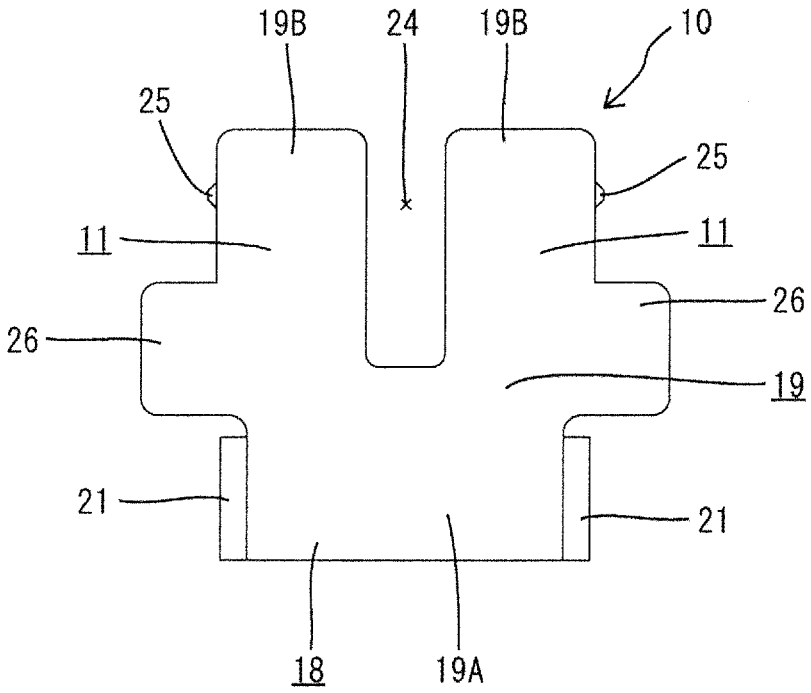
FIG. 5 is a bottom view of the retainer.
Figure 6:
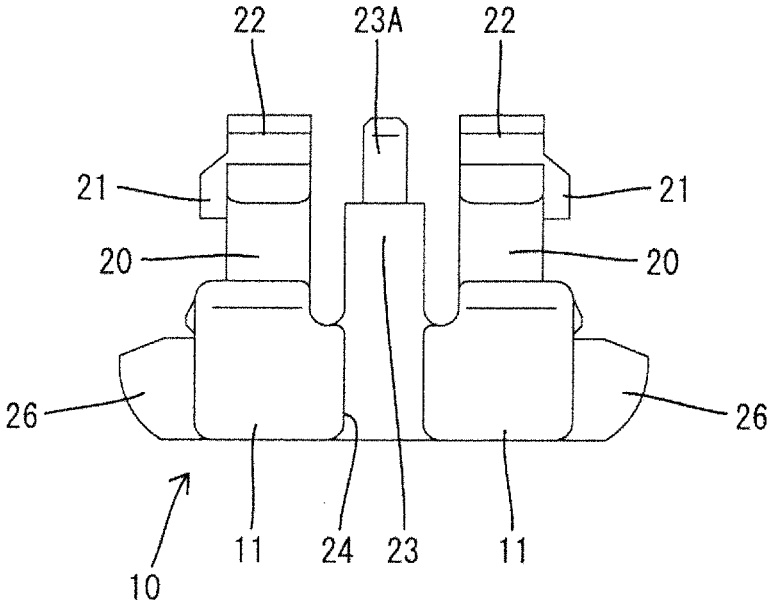
FIG. 6 is a front view of the retainer.
Figure 7:
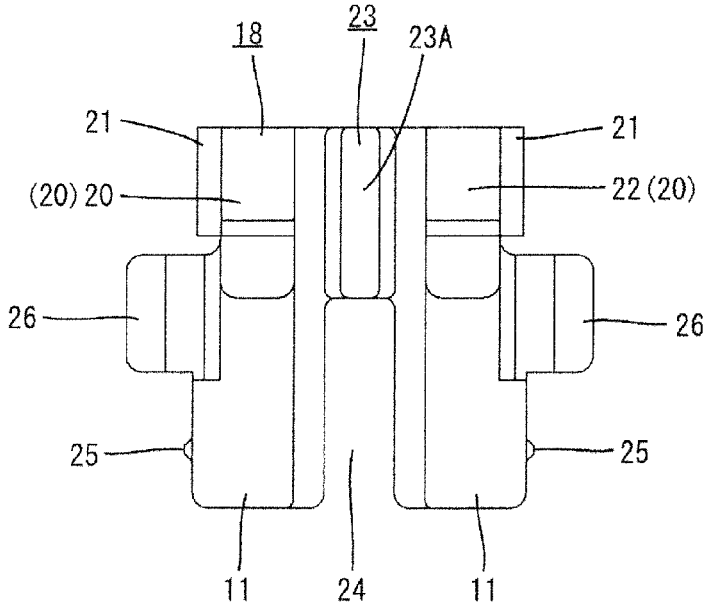
FIG. 7 is a plan view of the retainer.

FIGS. 5 to 7 show the retainer 10 of the male connector M. Similar to the male connector housing 1, the retainer 10 is also made of synthetic resin. The retainer 10 is formed unitarily to have a body 18 for locking the male terminal fittings 5 and the extended portions 11 for extending a pushing surface 19 of the retainer 10. As shown in FIG. 4, the entire retainer 10 can fit into the accommodating frame 12 of the male connector housing 1, and the lower pushing surface 19 of the retainer is substantially flush with the elongated projections 9 and the respective walls of the accommodating frame portion 12 when the retainer is at the full locking position.

A flat body side pushing surface 19A is formed on the lower surface of the body 18. Two legs 20 (housing locks) project up on opposite widthwise sides of the upper surface of the body 18. Locking claws 21 project on outer surfaces of the legs 20 near the tips of the legs 20. The legs 20 can be deformed resiliently in directions toward each other so that the locking claws 21 can be locked releasably to the partial lock receiving portions 16 and the full lock receiving portions 17 described above.

Sides of the legs 20 closer to the tips than the locking claws 21 define locking protrusions 22 for locking the male terminal fittings 5. When the retainer 10 is at the partial locking position, as shown in FIGS. 1 and 9, the locking protrusions 22 are below the corresponding cavities 4 so that the male terminal fittings 5 can be inserted into and withdrawn from the cavities 4. On the other hand, when the retainer 10 is at the full locking position, as shown in FIGS. 2 and 10, the locking protrusions 22 are in the corresponding cavities 4 to lock the male terminal fittings 5 and doubly retain the male terminal fittings 5 together with the locking lances 6.

A posture correcting portion 23 projects up in a widthwise central part of the upper surface of the body 18 between the legs 20. The posture correcting portion 23 has a width equal to the width of the body 18 in the front-back direction. As shown in FIG. 6, a tip is formed to be narrow in the width direction and defines a narrow portion 23A. When the retainer 10 is at the full locking position, the narrow portion 23A is fit in the cut recess 15 formed in the partition wall 14 between the cavities 4. A width of the narrow portion 23A in the front-back direction is slightly shorter than that of the cut recess 15 in the front-back direction. Thus, an inclined posture of the entire retainer 10 in the front-back direction can be restricted by the contact of the front or rear surface of the narrow portion 23A with the front or rear surfaces of the cut recess 15. Further, a thickness of the narrow portion 23A in the width direction is substantially equal to that of the partition wall 14. Thus, when the retainer 10 is at the full locking position, the narrow portion 23A constitutes a part of the partition wall 14.

The narrow portion 23A also has an excessive deformation preventing function and prevents the legs 20 from being resiliently deformed any further by contacting the widthwise inner surfaces of the legs 20 when the legs 20 are resiliently deformed inward and toward each other within a resiliency limit.

The extended portions 11 protrude unitarily back from the body 18. Extended-portion side pushing surfaces 19B extend continuously on upper surfaces of the extended portions 11 and are flush with the body side pushing surface 19A of the body 18. As shown in FIG. 5 and other figures, the extended portions 11 are forked in the width direction via a U-shaped groove 24 cut to extend in the front-back direction from the rear edge. As shown in FIG. 4, the center wall 12C of the accommodating frame portion 12 is fit into the U-shaped groove 24 of the retainer 10 at the full locking position, thereby being tightly held. As shown in FIG. 5, backlash filling projections 25 project in the width direction on widthwise outer side surfaces of both extended portions 11. The extended portions 11 fit between the center wall 12C and the opposite side walls 12B when the retainer 10 is at the full locking position and the backlash filling projections 25 are squeezed by the inner surfaces of the opposite side walls 12B. In this way, the extended portions 11 are sandwiched tightly between the center wall 12C and the side walls 12B and the entire retainer 10 is held without play.

Backlash restricting portions 26 project out in the width direction on boundaries between the extended portions 11 and the body 18 on opposite lateral sides of the retainer 10. The backlash restricting portions 26 fit tightly into the corresponding positioning recesses 13 of the male connector housing 1 when the retainer 10 is at the full locking position. In this way, the retainer 10 is held without play in the front-back direction.

Figure 11:
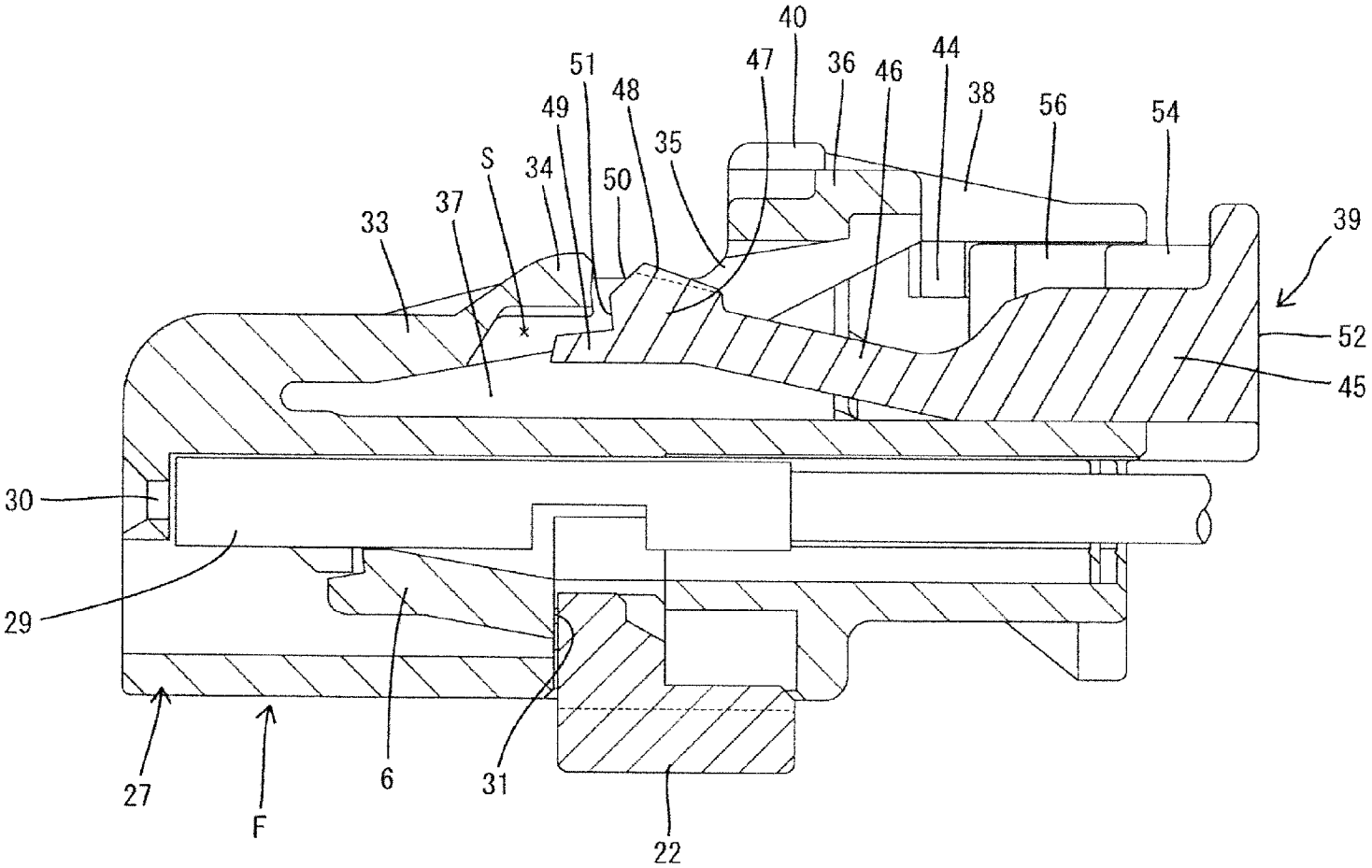
FIG. 11 is a side view in section showing a state where a detecting member is at an initial position in a female connector.
Figure 12:
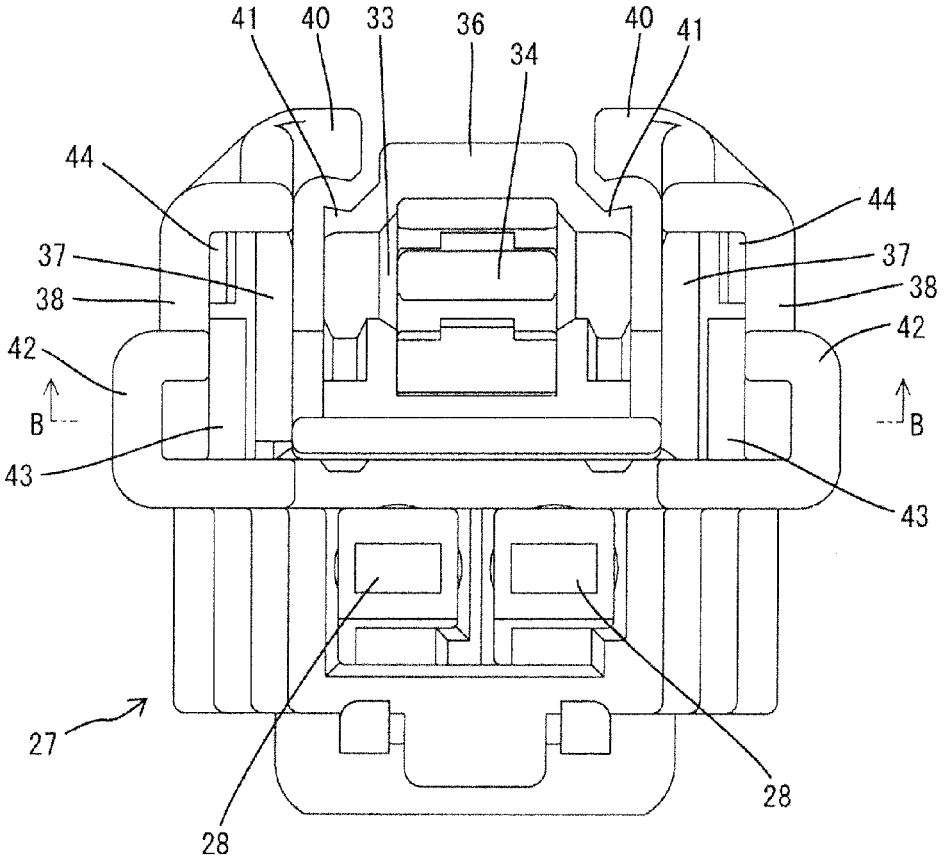
FIG. 12 is a rear view of a female connector housing.

The female connector F includes a female connector housing 27 made of synthetic resin and formed to fit into the receptacle 3 of the male connector housing 1. As shown in FIG. 12, two cavities 28 are formed side by side in the width direction in the female connector housing 27. As shown in FIG. 11, the cavities 28 penetrate in the front-back direction, and female terminal fittings 29 are insertable therein through rear ends. Tab insertion holes 30 are open on the front ends of the cavities 28 and the tabs 5A of the male terminal fittings 5 are insertable therein. A deflectable locking lance 6 for locking the female terminal fitting 29 is cantilevered obliquely forward from a lengthwise central part of each cavity 28.

As shown in FIG. 11, a retainer insertion hole 31 is open on a side of the lower surface of the female connector housing 27 behind the locking lances 6. A peripheral structure including this retainer insertion hole 31 and a structure of a retainer 32 to be mounted into the retainer insertion hole 31, as in the already described male connector M, and repeated description is omitted.

As shown in FIG. 11, a lock arm 33 is cantilevered back from the front of the upper surface of the female connector housing 27 and is resiliently deformable down with a front end part as a support. A lock projection 34 projects on the upper surface of a lengthwise central part of the lock arm 33. Two couplings 35 are connected to the lock arm 33 to extend back from opposite sides of the lock projection 34. The rear ends of the coupling 35 are slightly elevated and coupled to form an unlocking portion 36. In a state where the male and female connector housings 1, 27 are connected properly, the lock projection 34 is locked to the lock protrusion 7 of the receptacle 3 to lock the male and female connector housings 1, 27 in the connected state.

As shown in FIG. 12 and other figures, two lock-arm protection walls 37 stand at the opposite sides of the lock arm 33 in the width direction on the upper surface of the female connector housing 27. The lock-arm protection walls 37 extend back in the front-back direction from a front end part of the upper surface of the female connector housing 27 and the rear ends thereof are slightly before the rear end of the unlocking portion 36. In a side view of the female connector housing 27, the lock-arm protection walls 37 have a height so that only the lock projection 34 and the unlocking portion 36 project higher (see FIG. 13).

Figure 14:
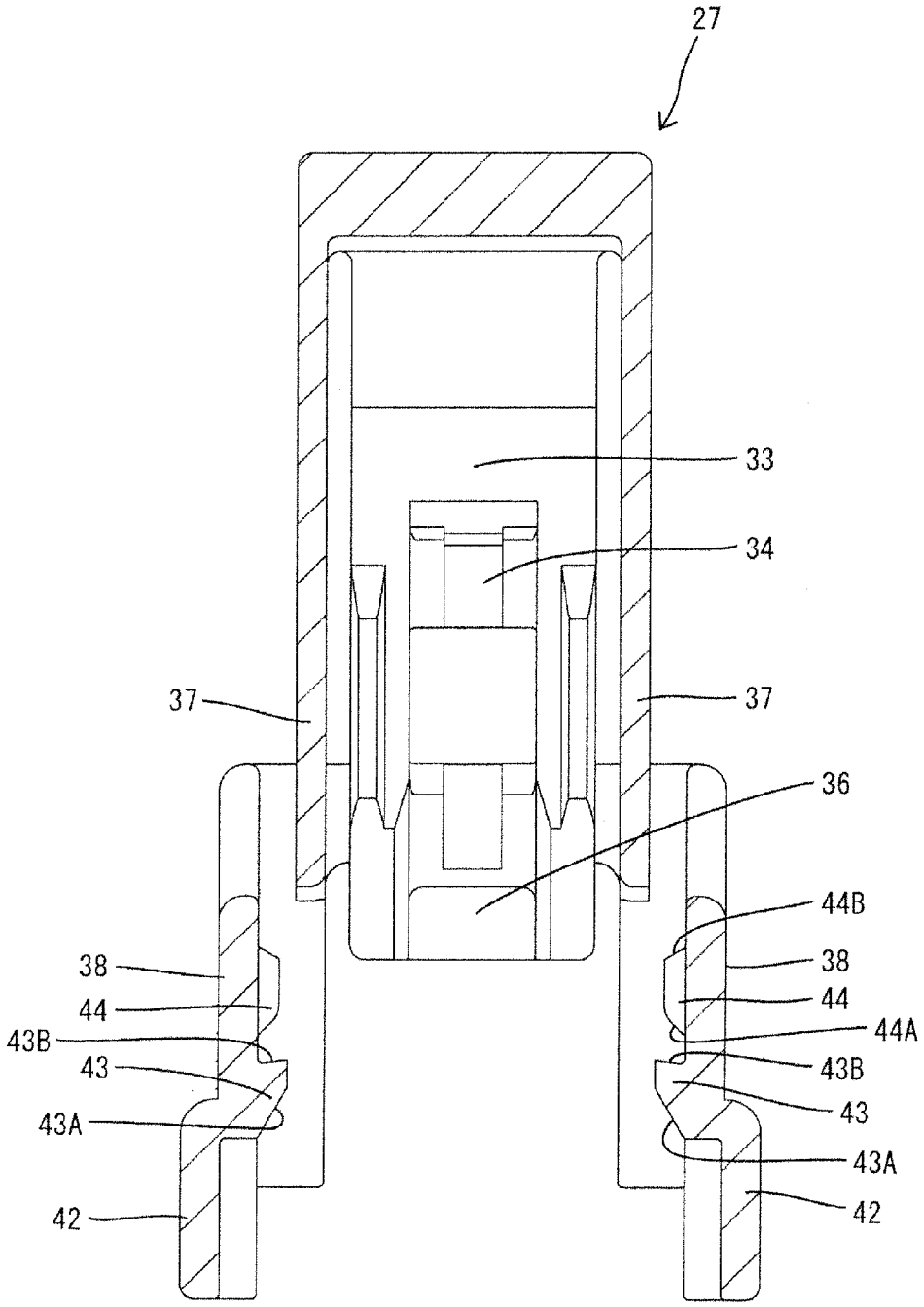
FIG. 14 is a view showing a cross-section along B-B of FIG. 12 in a vertically inverted manner.

Two detector protection walls 38 stand behind the lock-arm protection walls 37 on the upper surface of the female connector housing 27. A space defined by the detector protection walls 38 and the upper surface of the female connector housing 27 defines an accommodation space for a detector 39. The detector protection walls 38 are located at outer sides of the lock-arm protection walls 37 in the width direction, as shown in FIG. 12, and the rear end surfaces of the lock-arm protection walls 37 are located at inner sides of the detector protection walls 38 in the width direction, as shown in FIG. 14.

As shown in FIG. 12, upper parts of the detector protection walls 38 are bent substantially at a right angle to extend inward. Further, upper parts of the front ends of the detector protection walls 38 project up and are bent in to form two inversion preventing portions 40 that face each other in the width direction. Contrary to this, opposite lateral sides of the unlocking portion 36 of the lock arm 33 protrude out in the width direction to form jaws 41. The jaws 41 contact inner sides of the inversion preventing portions 40 when the lock arm 33 is deformed up, thereby preventing warping deformation of the lock arm 33 beyond its resiliency limit.

Lower parts of the rear ends of the detector protection walls 38 protrude out in the width direction and back to form protruding frame portions 42. As shown in FIG. 12, the protruding frame portions 42 have a C shape or an inverted C shape open inward in a rear view of the female connector housing 27.

Figure 13:
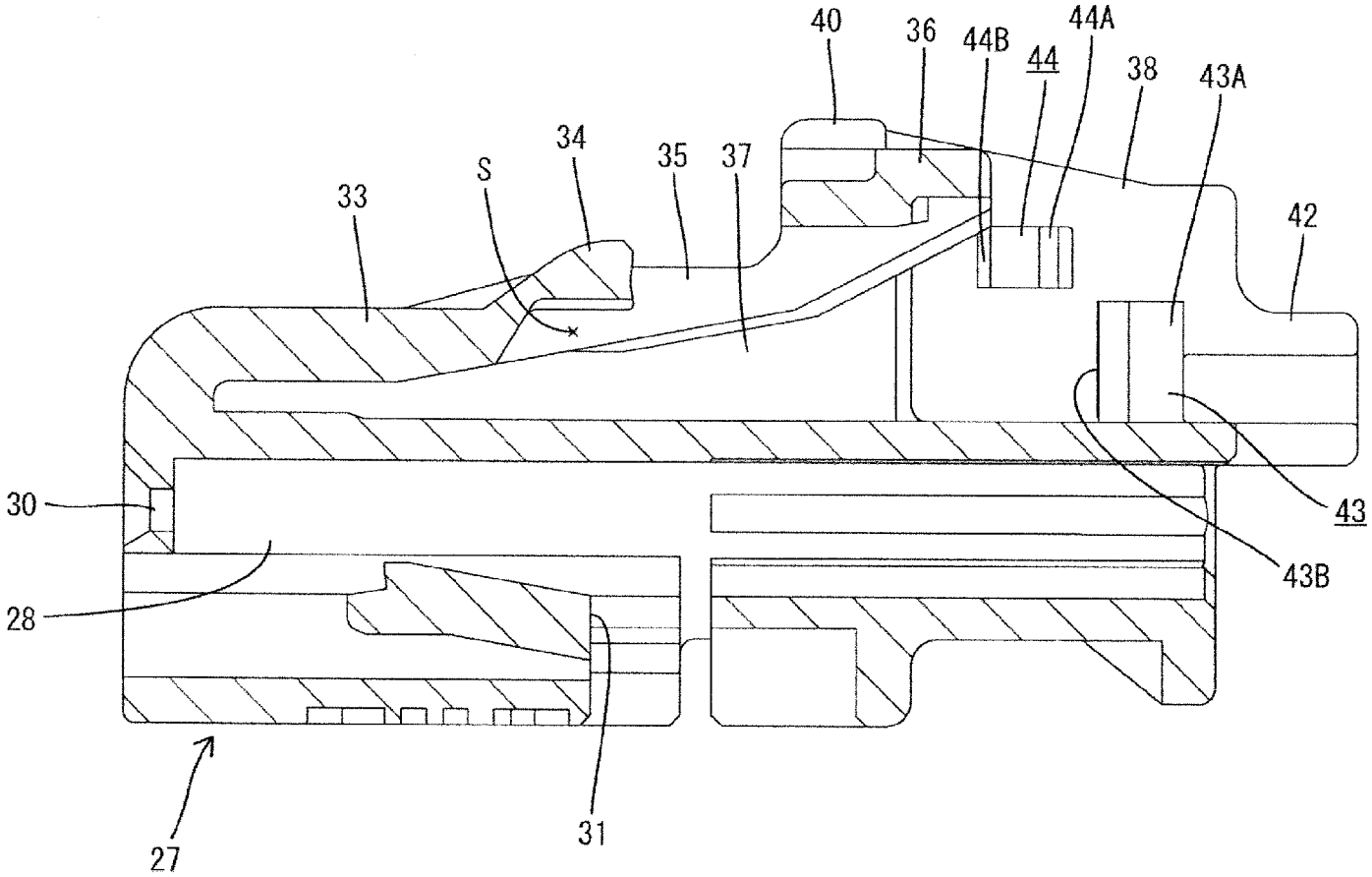
FIG. 13 is a side view in section of the female connector housing.

As shown in FIG. 13 and other figures, first and second lock receiving portions 43, 44 are provided on the inner surfaces of the detector protection walls 38 while being paired in the width direction for restricting a backward movement of the detector 39 at an initial position and a detecting position. As shown in FIG. 12, the lock receiving portions 43, 44 are displaced in a height direction so as not to overlap each other in the height direction in the rear view. This enables the lock receiving portions 43, 44 to be molded by removing a mold in the front-back direction.

Further, as shown in FIG. 14, the lock receiving portions 43, 44 are more outward in the width direction than backward extensions of the lock-arm protection walls 37. The first lock receiving portions 43 are rearward and lower than the second lock receiving portions 44 and are connected to the upper wall of the female connector housing 27, as shown in FIG. 13. The first lock receiving portions 43 prevent the detector 39 from being detached backward from the initial position. As shown in FIG. 14, the first lock receiving portions 43 have tapered rear surfaces 43A and upright lock receiving front surfaces 43B.

The second lock receiving portions 44 are located before the first lock receiving portions 43, are at higher positions and are designed to make a backward movement of the detector 39 from the detecting position difficult. As shown in FIG. 14, the second lock receiving portions 44 have front and rear tapered surfaces 44A, 44B. However, the front and rear tapered surfaces 44A, 44B are inclined toward opposite sides and the front tapered surfaces 44B are slightly steeper and closer to upright.

Figure 18:
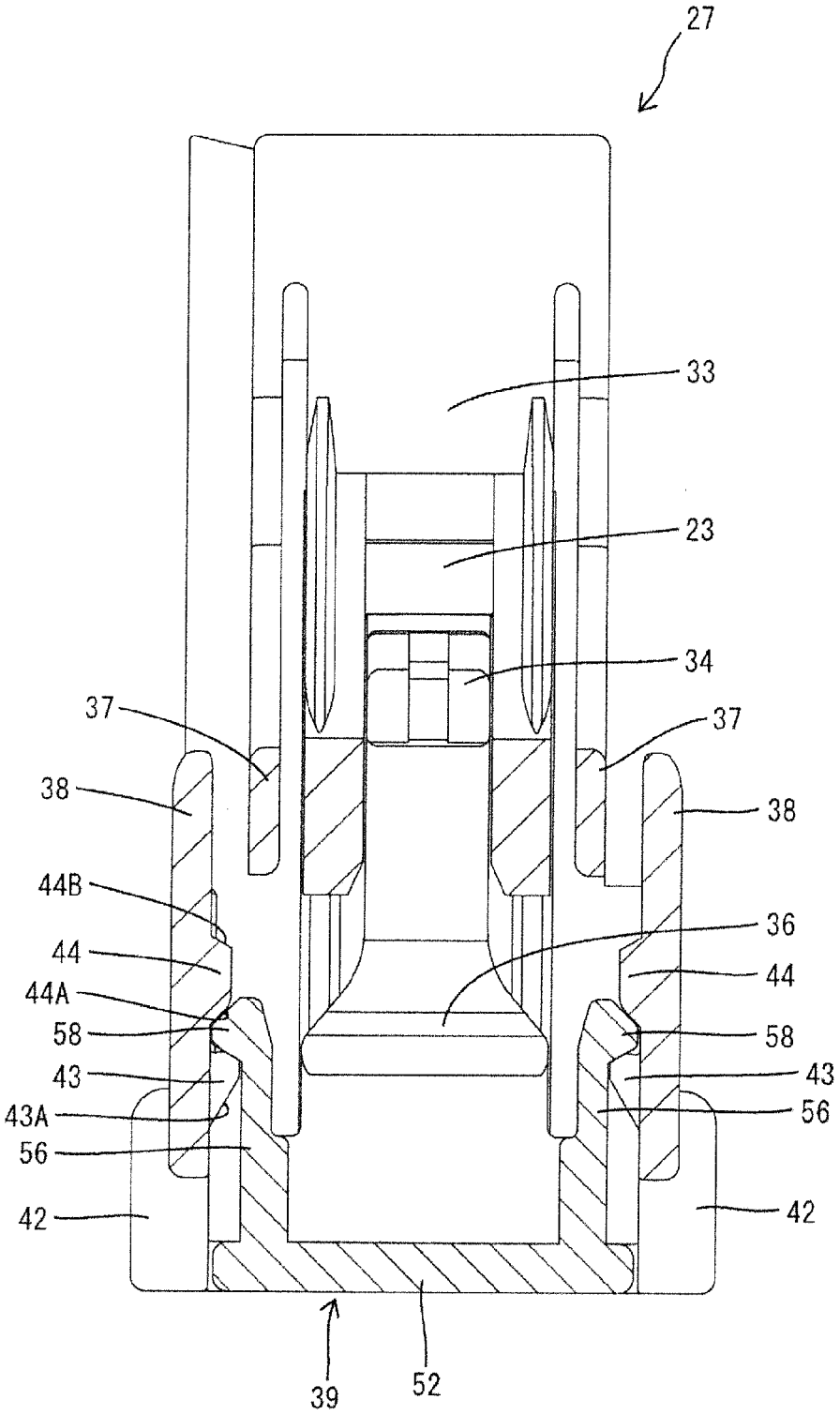
FIG. 18 is a view, corresponding to FIG. 14, when the detector is at the initial position.
Figure 19:
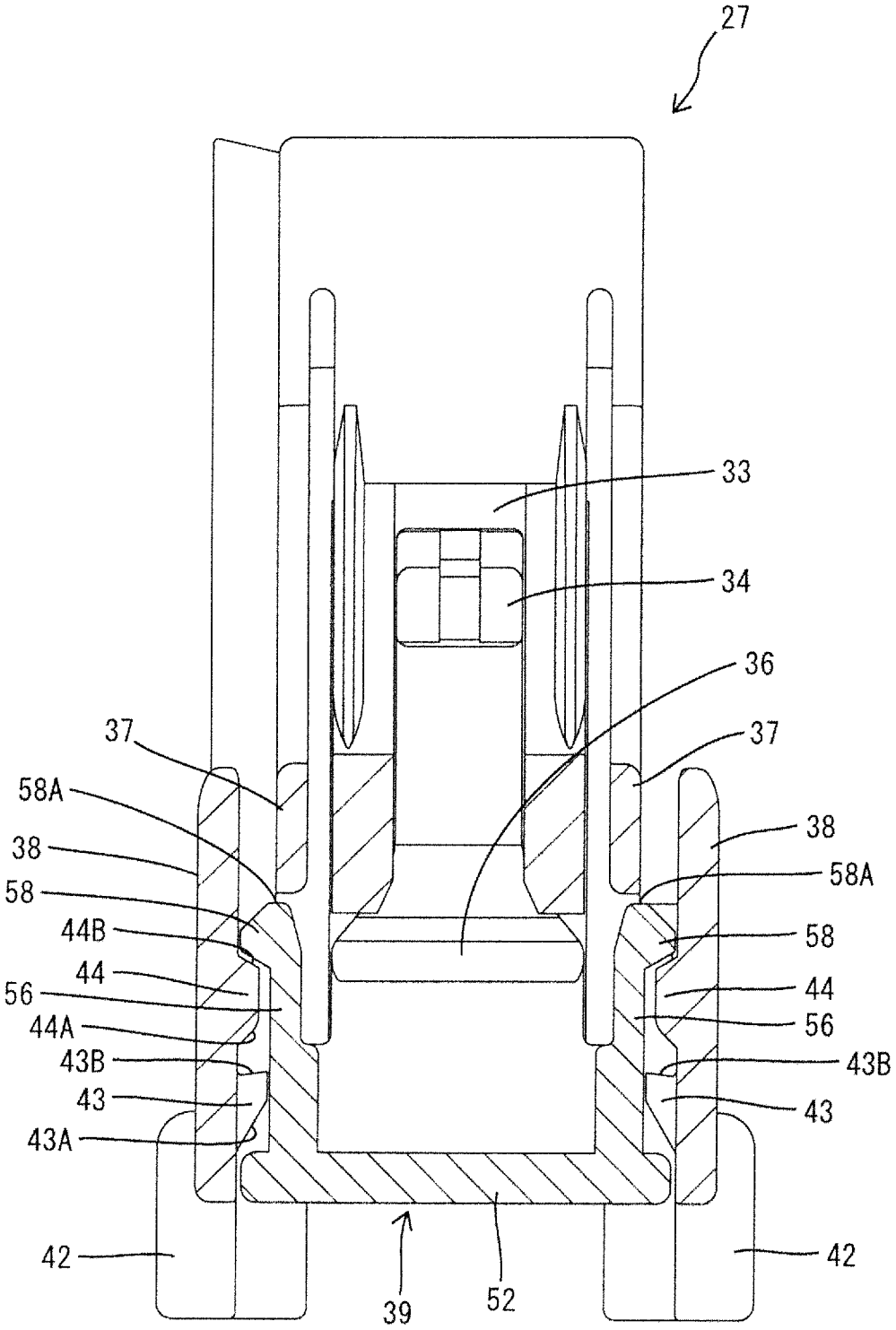
FIG. 19 is a view, corresponding to FIG. 14, when the detector is at a detecting position.
Figure 20:
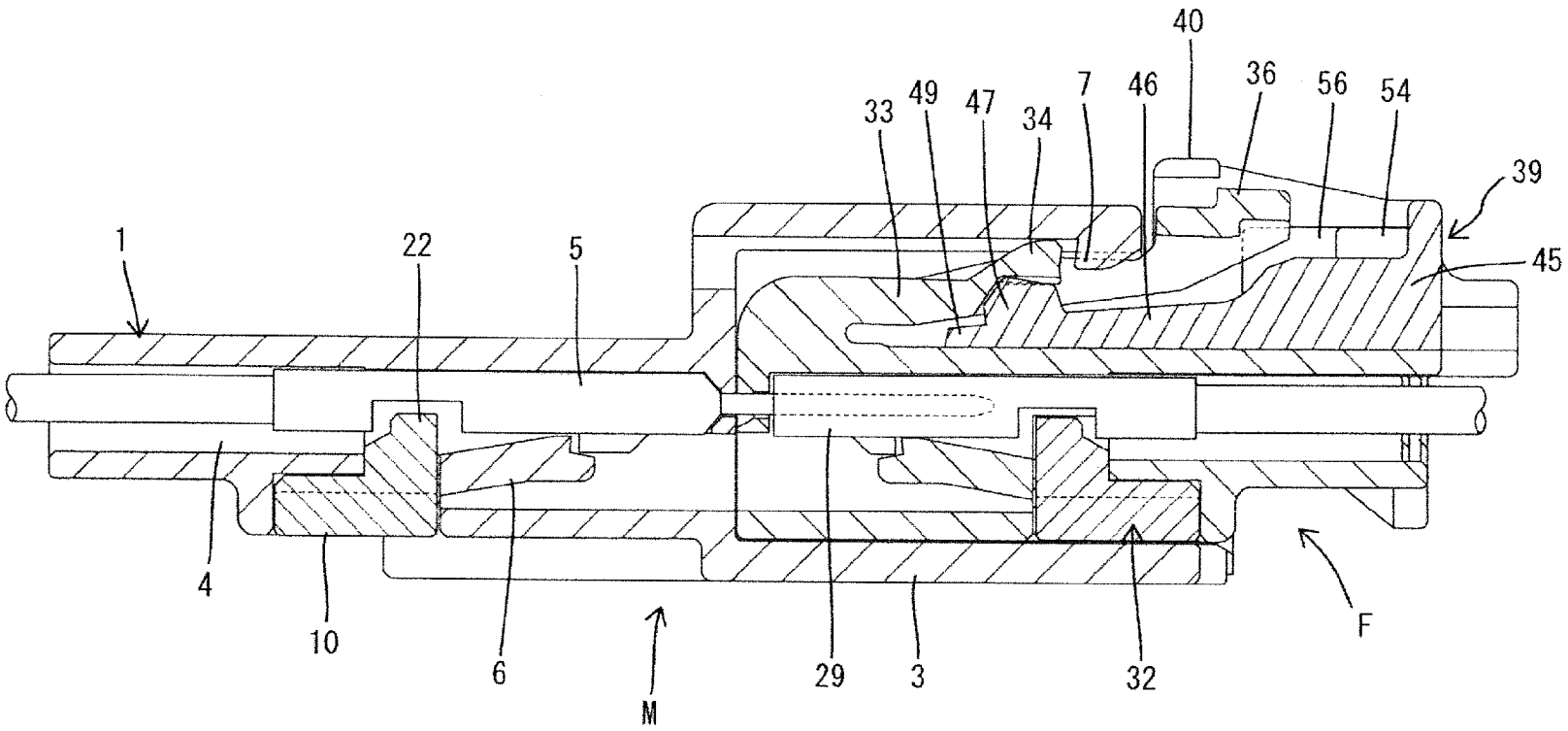
FIG. 20 is a side view in section showing a state where the male and female connectors are properly connected.

The detector 39 is mounted into the female connector housing 27 for movement between the initial position shown in FIGS. 11 and 18 and the detecting position shown in FIGS. 19 and 20. The detector 39 can detect whether or not the male and female connectors M, F are connected properly based on whether the detector 39 can be pushed from the initial position to the detecting position.

The detector 39 also is made of synthetic resin and includes a base 45 and a resilient arm 46 integrally coupled to the front surface of the base 45. The resilient arm 46 is cantilevered forward and defines a substantially rectangular bar that is resiliently deformable in the height direction with a base end part as a support. In a natural state, the resilient arm 46 is inclined up toward the front.

A substantially rectangular block-shaped protrusion 47 projects up on an upper part of the front end of the resilient arm 46. A widthwise central part of the upper surface of the protrusion 47 is raised into a rib-shaped auxiliary protrusion 48. A contact portion 49 projects forward on a lower part of the front end of the resilient arm 46. When the detector 39 is at the initial position, as shown in FIG. 11, the contact portion 49 is in an accommodation space S defined below the lock projection 34 of the lock arm 33. Thus, when the lock arm 33 is deformed resiliently down at the time of connecting the male and female connectors M, F, the contact portion 49 is pushed down by the lower surface of the lock projection 34. Therefore the resilient arm 46 is deformed resiliently down as the lock arm 33 is deformed resiliently down.

As shown in FIG. 11, a tapered guide surface 50 inclined upward toward the back is formed on the upper surface of the protrusion 47. Further, a substantially upright movement restricting surface 51 is formed on the front surface of the protrusion 47. The movement restricting surface 51 faces the tip surface of the lock projection 34 and can come into contact therewith when the detector 39 is at the initial position, thereby restricting an inadvertent movement of the detector 39 from the initial position to the detecting position.

The lock projection 34 slides in contact with the lock protrusion 7 of the receptacle 3 and the lock arm 33 is pushed down while the male and female connectors M, F are being connected. Associated with this, the resilient arm 46 also is pushed down. The lock arm 33 returns to an initial state when the male and female connectors M, F are connected properly. However, since the lock protrusion 7 of the receptacle 3 pushes the auxiliary protrusion 48, the resilient arm 46 is held in a pushed-down state. As a result, a contact state of the movement restricting surface 51 and the tip surface of the lock projection 34 is released and the detector 39 can move forward toward the detecting position.

Figure 15:
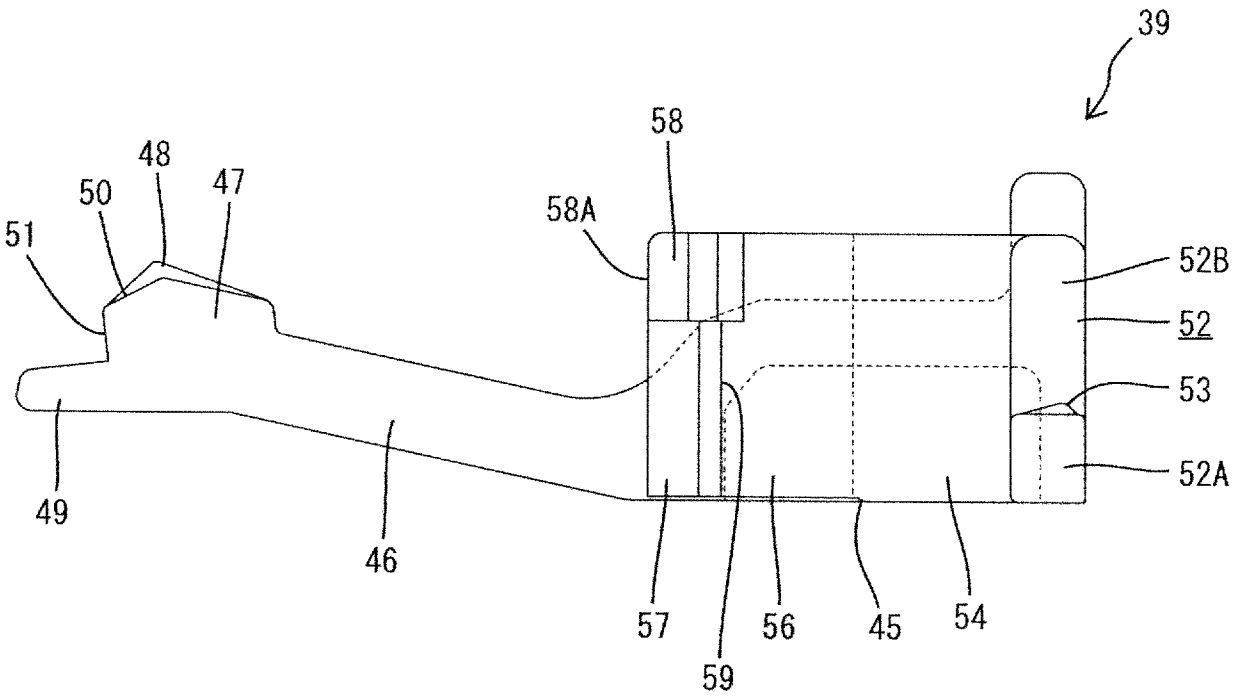
FIG. 15 is a side view of the detector.
Figure 16:
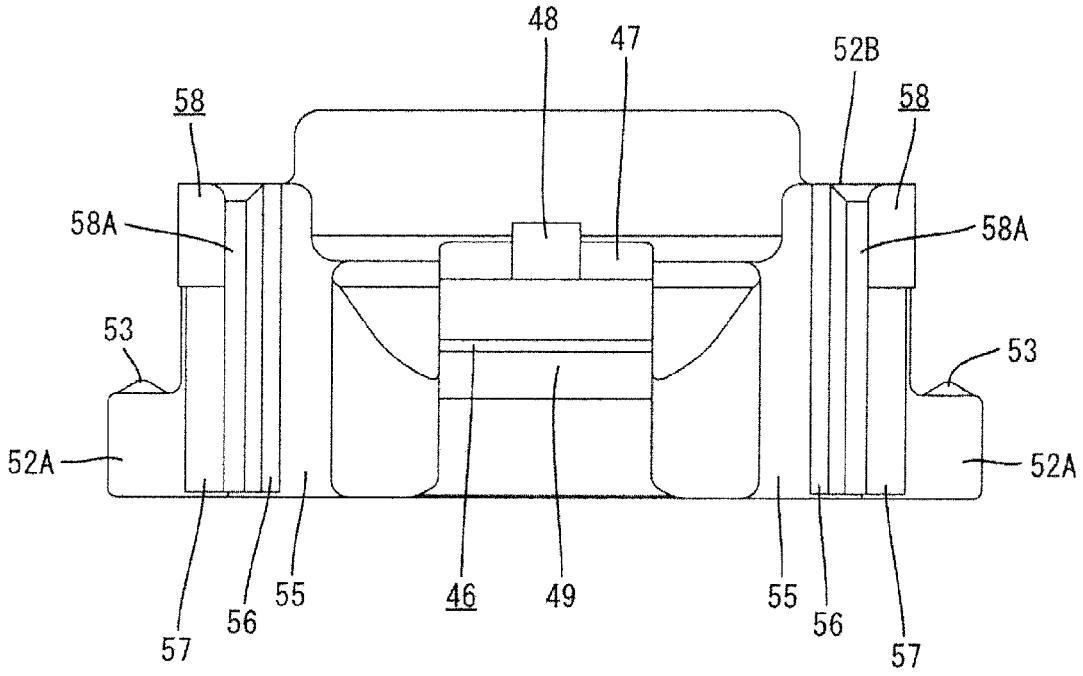
FIG. 16 is a front view of the detector.

The rear surface of the base 45 defines a pushing wall 52. As shown in FIGS. 15 and 16, opposite side parts of the pushing wall 52 in the width direction are formed to have a step shape in the height direction and lower end parts thereof define first steps 52A that protrude most outwardly. The first steps 52A can move in the protruding frame portions 42 as the detector 39 moves between the initial position and the detecting position. Pointed sliding projections 53 are formed on the upper surfaces of both first steps 52A and achieve point contact with ceiling surfaces in the protruding frame portions 42 to reduce sliding resistance when the detector 39 is pushed. Further, second steps 52B of the pushing wall 52 are higher than the upper surface of the base 45, and two side walls 54 extend forward from the front surfaces of the second steps 52B. The side walls 54 are formed to fit into spaces at inner sides of the detector protection walls 38 of the female connector housing 27.

Figure 17:
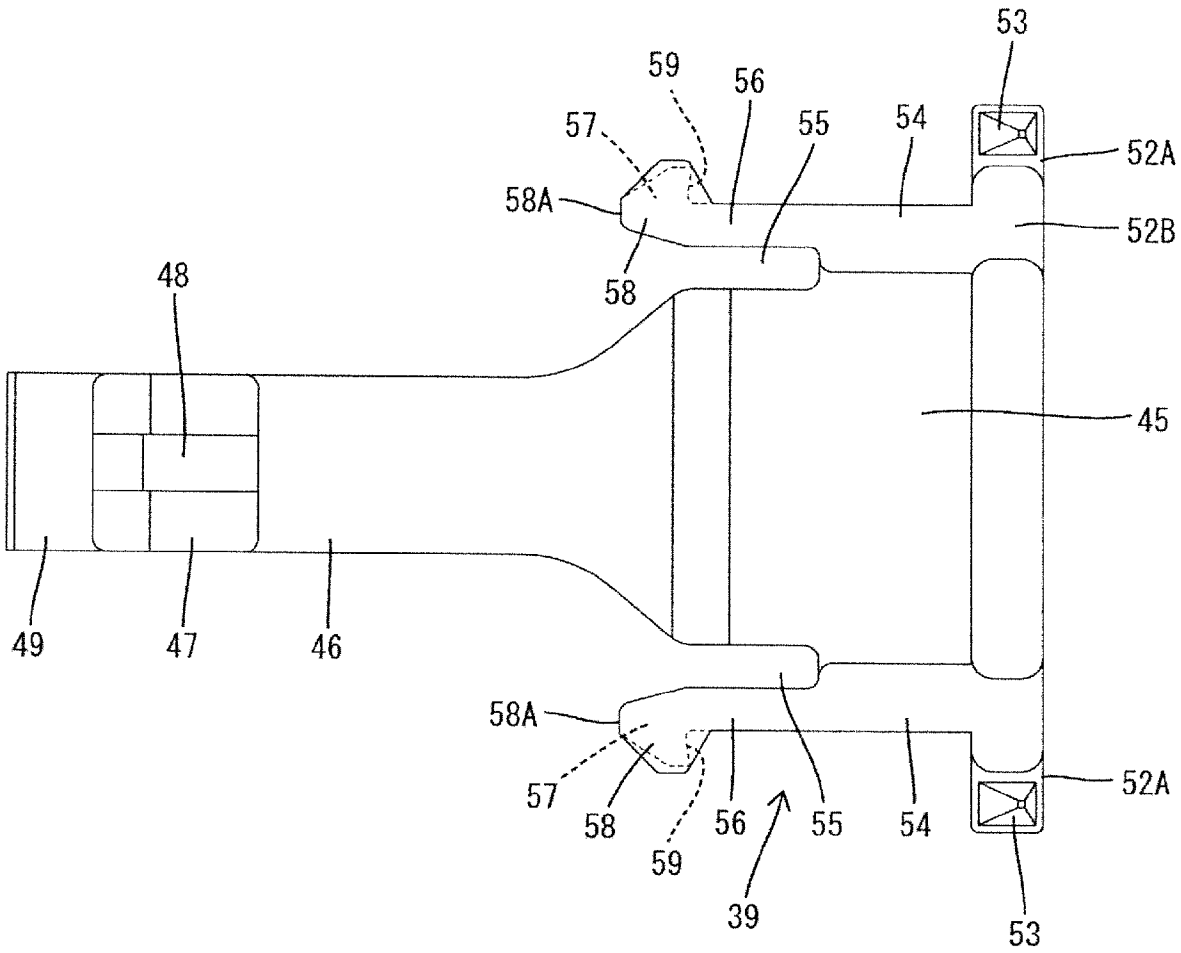
FIG. 17 is a plan view of the detector.

As shown in FIG. 17, two slits 55 are formed forward of the side walls 54 and at opposite sides of the base 45 to define two deflectable locking arms 56 at outer sides of the slits 55 in the width direction.

The locking arms 56 are deflectable inward in the width direction. First and second claws 57 and 58 are provided one above the other on tips of each locking arm 56 and project out, as shown in FIG. 16. The first claws 57 are at lower positions and can be locked to the first lock receiving portions 43 of the female connector housing 27. The rear surfaces of the first claws 57 define upright locking surfaces 59, as shown in FIG. 15, and can lock to the lock receiving surfaces 43B of the first lock receiving portions 43 when the detector 39 is at the initial position. The locking surfaces 59 and the lock receiving surfaces 43B are upright surfaces and are locked to each other for strongly resisting a backward detachment of the detector 39 at the initial position.

Conversely, both front and rear surfaces of the second claws 58 are tapered. The front surfaces 58A extend laterally along a direction perpendicular to a pushing direction of the detector 39. Accordingly, when the detector 39 is at the initial position, the second claws 58 contact the rear surfaces of the second lock receiving portions 44, as shown in FIG. 18, to restrict forward movement of the detector 39. Further, when the detector 39 is at the detecting position, the front end surfaces 58A face and contact the rear end surfaces of the lock-arm protection walls 37 to lock the second claws 58 with the second lock receiving portions 44, as shown in FIG. 19, thereby preventing the detector 39 from being pushed forward from the detecting position.

As shown in FIGS. 18 and 19, the locking arms 56 are located substantially on backward extensions of the lock-arm protection walls 37 when the detector 39 is at the initial position and the detecting position. When being resiliently deformed inwardly, the locking arms 56 cross these extensions toward widthwise inner sides. In this way, dead spaces behind the lock-arm protection walls 37 can be utilized as deflection spaces for the locking arms 56.

The retainer 10 is held in the partly locked state shown in FIG. 9 when mounting the male terminal fittings 5 into the male connector housing 1. At this time, the locking protrusions 22 of the legs 20 are retracted outward from the cavities 4 so that the male terminal fittings 5 can be inserted into the cavities 4. The male terminal fittings 5 inserted to proper positions are locked primarily by the locking lances 6.

The pushing surface 19 of the retainer 10 then is pushed, and the legs 20 deform resiliently in so that the locking claws 21 are unlocked from the partial lock receiving portions 16 and the entire retainer 10 is inserted into the retainer insertion hole 8. When the retainer 10 reaches the full locking position, the locking claws 21 are locked to the full lock receiving portions 17 and the locking protrusions 22 are inserted into the cavities 4 to lock the male terminal fittings 5. Thus, the male terminal fittings 5 are retained by both the locking protrusions 22 and the locking lances 6.

Note that an operation of mounting the female terminal fittings 29 into the female connector housing 27 can be performed in the same manner as described above.

The detector 39 is held at the detecting position before the female connector F is connected to the male connector M. A front end of the female connector housing 27 then is fit into the receptacle 3 and the lock projection 34 of the lock arm 33 contacts the front end of the lock protrusion 7 of the receptacle 3 in the connecting process. The lock protrusion 7 applies a downward pushing force that resiliently deforms the lock arm 33 down as the connecting operation progresses. The contact portion 49 of the resilient arm 46 of the detector 39 also receives a downward pushing force as the lock arm 33 is pushed down, and the resilient arm 46 deforms resiliently down.

The male and female terminal fittings 5, 29 are connected properly when the male and female connectors M, F are connected to a proper depth. At this time, the lock arm 33 returns so that the lock projection 34 engages the inner surface of the lock protrusion 7 of the receptacle 3. Additionally, the lock protrusion 7 of the receptacle 3 is in contact with the auxiliary protrusion 48 of the resilient arm 46, and keeps the resilient arm 46 deformed resiliently down. A contact state of the movement restricting surface 51 of the resilient arm 46 and the tip surface of the lock projection 34 of the lock arm 33 already is released at this time, thereby releasing a movement restricted state of the detector 39. Thus, the guide surface 50 of the protrusion 47 of the resilient arm 46 slides in contact with the lower edge of the tip of the lock projection 34 of the lock arm 33 when the pushing wall 52 is pushed. As a result, the detector 39 reaches the detecting position while pushing the resilient arm 46 further down. At this position, the protrusion 47 of the resilient arm 46 is inserted between the lock projection 34 of the lock arm 33 and the upper surface of the female connector housing 27 to be held in contact with both. Thus, the deflection of the lock arm 33 in an unlocking direction is restricted and the male and female connectors M, F are locked reliably in the connected state.

Before reaching the detecting position, the detector 39 no longer is held at the initial position where the first claws 57 of the locking arms 56 and the first lock receiving portions 43 are locked together. Then, the locking arms 56 are deflected in and the second claws 58 move over the second lock receiving portions 44. When the detector 39 reaches the detecting position, the second claws 58 are locked to the second lock receiving portions 44 and the front end surfaces 58A of the second claws 58 contact the rear end surfaces of the lock-arm protection walls 37, thereby preventing the detector 39 from moving farther forward.

The retainer 10 is configured so that the extended portions 11 extend from the body 18 and the extended-portion side pushing surfaces 19B are formed in addition to the body side pushing surface 19. This enables the entire retainer 10 to be pushed easily even if the retainer 10 is small. Further, the pushing surface 19 is extended toward the rear from the body 18. Thus, an insertion posture into the retainer insertion hole 8 tends to incline. However, the posture correcting portion 23 is provided and the retainer 10 can be corrected to have a proper insertion posture instead of having an inclined posture by fitting the tip of the posture correcting portion 23 into the cut recess 15 of the partition wall 14 (see FIG. 8).

The posture correcting portion 23 is provided between the legs 20 in the retainer 10. Thus, the posture correcting portion 23 also prevents excessive deformation of the legs 20.

Further, the backlash filling projections 25 project on the widthwise side surfaces of both extended portions 11 of the retainer 10 and are squeezed by the inner surfaces of the opposite side walls when the retainer 10 is at the full locking position. Thus, both extended portions 11 are sandwiched tightly between the center wall and the side walls and the entire retainer 10 can be held without play in the width direction. Furthermore, the backlash restricting portions 26 project out in the width direction on the retainer 10 and fit tightly into the corresponding positioning recesses 13 of the male connector housing 1 when the retainer 10 is at the full locking position. Thus, the retainer 10 is held without play in the front-back direction.

Both locking arms 56 of the female connector F are located substantially on backward extensions of the lock-arm protection walls 37 when the detector 39 is at the initial position and the detecting position. The locking arms 56 cross these extensions toward the widthwise inner sides while being resiliently deformed inward. Specifically, the locking arms 56 are arranged utilizing the dead spaces behind the lock-arm protection walls 37 and are deformed resiliently inward. Thus, the connector can be made smaller in the width direction as compared with the case where the locking arms 56 are deformed outward.

The first and second lock receiving portions 43, 44 in the female connector housing 27 for holding the detector 39 at the initial position and the detecting position are displaced so as not to overlap in the height direction, and hence can be formed by a mold that is opened and closed in the front-back direction. Thus, a mold structure for the female connector housing 27 can be simplified.

The tip of the resilient arm 46 of the detector 39 is in contact with the lock arm 33 and the second claws 58 of the locking arms 56 are in contact with the rear surfaces of the second lock receiving portions 44 when the detector 39 is at the initial position. Thus, a forward movement is restricted reliably at the initial position. Further, at the initial position, the first claws 57 are locked to the first lock receiving portions 43 and the locking surfaces and the lock receiving surfaces thereof are upright surfaces. Thus, the detector 39 cannot be detached outward at the initial position.

When the detector 39 is at the detecting position, the front end surfaces 58A of the second claws 58 of the detector 39 are in contact with the rear end surfaces of the lock-arm protection walls 37 to restrict a forward movement. Simultaneously, the second claws 58 are locked to the front surfaces of the second lock receiving portions 44 to prevent a return to the initial position.

The invention is not limited to the above described and illustrated embodiment. For example, the following embodiments also are included in the scope of the invention.

The extended portions of the retainer extend toward rear of the body in the above embodiment. However, they may extend toward both the front and rear.

The posture correcting portion of the retainer also prevents excessive deformation of the legs in the above embodiment, but a posture correcting function and an excessive deformation preventing function may be set at different positions.

The posture correcting portion of the retainer is locked to the cut recess formed on the partition wall to correct the posture of the retainer in the above embodiment. However, it may be locked at a position other than the partition wall.

Deflection of the lock arm is restricted when the detecting member reaches the detecting position in the above embodiment. However, the deflection may not necessarily be restricted.

LIST OF REFERENCE SIGNS

1 . . . male connector housing
3 . . . receptacle
5 . . . male terminal fitting
8 . . . retainer insertion hole
10 . . . retainer
11 . . . extended portion
13 . . . positioning recess
14 . . . partition wall
15 . . . cut recess
18 . . . body
20 . . . leg portion (housing locking portion)
21 . . . locking claw (housing locking portion)
22 . . . locking protrusion (terminal locking portion)
23 . . . posture correcting portion
27 . . . female connector housing
29 . . . female terminal fitting

32 . . . retainer
33 . . . lock arm
37 . . . lock-arm protection wall
38 . . . detector protection wall
39 . . . detector
43 . . . first lock receiving portion
44 . . . second lock receiving portion
57 . . . first claw
58 . . . second claw

What is claimed is:

1. A connector, comprising:

a housing connectable to a mating housing;

a lock arm extending back from a front end part of the housing and being deflectable in a height direction intersecting a connecting direction of the housing and the mating housing, the lock arm being configured to be locked to the mating housing to hold a connected state when the housing and the mating housing are connected properly;

a pair of lock-arm protection walls standing on the housing and extending along the connecting direction at opposite sides of the lock arm in a width direction;

a detector to be mounted into the housing and being movable between an initial position and a detecting position, the detector being configured to contact the lock arm from behind to restrict a forward movement at the initial position before the housing is connected to the mating housing and to enter a deflection space for the lock arm to restrict the deflection of the lock arm when released from a movement restricted state at the initial position and reaching the detecting position by being pushed forward from the initial position when the housing is connected properly to the mating housing;

detector protection walls configured to cover the detector by standing behind and at widthwise outer sides of the lock-arm protection walls on the housing;

first and second lock receiving portions formed on inner surfaces of the detector protection walls; and locking arms formed on opposite widthwise sides of the detector and being resiliently deformable inward in the width direction, and being releasably locked to the first and second lock receiving portions (43, 44) for restricting a backward movement of the detector when the detector is at the initial position and the detecting position, the locking arms being arranged to cross backward extensions of the lock-arm protection walls in the connecting direction toward widthwise inner sides when being resiliently deformed.

2. The connector of claim 1, wherein the first and second lock receiving portions are displaced so as not to overlap in a height direction in a rear view of the connector.

3. The connector of claim 2, wherein claws project out in the width direction on tips of the locking arms, the claws having front and rear surfaces, the rear surfaces of the claws in the connecting direction being lockable to the front surfaces of the first lock receiving portions when the detector is at the initial position.

4. The connector of claim 3, wherein the front and rear surfaces of the claws contact the rear surfaces of the lock-arm protection walls and the front surfaces of the second lock receiving portions to hold the detector at the detecting position.

* * * * *